US007970304B2

(12) United States Patent
Brown

(10) Patent No.: US 7,970,304 B2
(45) Date of Patent: Jun. 28, 2011

(54) METHOD OF IMPROVING DEVELOPED FLAT FIELD UNIFORMITY

(75) Inventor: Kenneth J. Brown, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 377 days.

(21) Appl. No.: 12/333,355

(22) Filed: Dec. 12, 2008

(65) Prior Publication Data

US 2010/0150592 A1 Jun. 17, 2010

(51) Int. Cl.
*G03G 15/08* (2006.01)

(52) U.S. Cl. ..... 399/53

(58) Field of Classification Search ..... 399/53, 399/49, 274, 284

See application file for complete search history.

(56) References Cited

U.S. PATENT DOCUMENTS

| | | | | |
|---|---|---|---|---|
| 4,227,796 | A | 10/1980 | Kamp et al. | |
| 4,847,659 | A | 7/1989 | Resch, III | |
| 5,475,469 | A | 12/1995 | Okada et al. | |
| 5,815,768 | A | 9/1998 | Clifton | |
| 6,084,567 | A | 7/2000 | Ogawa | |
| 6,416,916 | B1 | 7/2002 | Silence et al. | |
| 6,580,879 | B2 | 6/2003 | Coleman et al. | |
| 6,810,226 | B2 | 10/2004 | Phillips et al. | |
| 6,829,443 | B2 | 12/2004 | Byun et al. | |
| 2009/0080920 | A1 * | 3/2009 | Carter et al. | 399/49 |
| 2010/0158547 | A1 * | 6/2010 | Carling et al. | 399/27 |

* cited by examiner

*Primary Examiner* — Quana M Grainger
(74) *Attorney, Agent, or Firm* — Donna P. Suchy

(57) ABSTRACT

Flat field uniformity can be improved in images produced by an image development system having a development roller interposed between a supply of developer and an imaging element. A raw feed of developer is supplied from the developer supply to the development roller to produce both a metered feed of developer and an overfeed of developer, which is returned to the supply, from the raw feed. A plurality of mass densities of developer used in the system and a plurality of developer velocities through the system are determined, and respective product values of those developer mass densities and those developer velocities are thereafter calculated or otherwise determined. A maximum value of the respective product values is identified, and the image development system is then operated so that the maximum product value is produced.

20 Claims, 4 Drawing Sheets

| MF | OF | | | Calc ND*NV |
|---|---|---|---|---|
| 2.0 | 1.2 | | | 44 |
| 2.0 | 1.5 | | | 42 |
| 2.0 | 1.7 | | | 42 |
| 2.5 | 1.2 | | | 52 |
| 2.5 | 1.5 | | | 51 |
| 2.5 | 1.7 | | | 50 |
| 3.3 | 1.2 | | | 66 |
| 3.3 | 1.5 | | | 65 |
| 3.3 | 1.7 | | | 64 |

METHOD OF IMPROVING DEVELOPED FLAT FIELD UNIFORMITY

FIELD OF THE INVENTION

This invention concerns a way of improving flat field uniformity in images produced by an image development system having a development roller interposed between a supply of developer and an imaging element.

BACKGROUND OF THE INVENTION

In a two-component development system, the ability to apply sufficient developer (toner and carrier) to develop a latent image on a photoconductor is critical to the creation of images with high fidelity and quality. In general practice, developer "flow" is the common metric used to describe the amount of developer delivered to the toning zone per unit time. Flow measurement is accomplished by lowering a gate (2 inches wide) into the developer stream and collecting developer for a specified amount of time (0.5 seconds). This developer is then weighed, and developer flow is reported in units of grams/inch/second. Developer flow has been correlated against certain imaging properties of the developer, such as toning contrast, background, and so on. This measurement method, although useful, needs to be made with the developer station removed from the machine, requires a scale, and thus is not well suited for a real time application.

SUMMARY OF THE INVENTION

According to the present invention, therefore, a process of adjusting flat field uniformity in images produced by an image development system having a development roller interposed between a supply of developer and an imaging element is proposed. In this process, a raw feed of developer is supplied to the development roller, and both a metered feed and an overfeed of developer, which overfeed is returned to the supply, are produced from the raw feed. A plurality of mass densities of developer used in the system are determined, as are a plurality of developer velocities through the system. Respective product values of the developer mass densities and the developer velocities are then determined, and a maximum value of the respective product values is identified. The image development system is then operated so as to produce the maximum value.

In one preferred configuration, the metered feed is produced by way of a gap between a metering element and said development roller, and the metering element is a skive or gate. The metered feed can be made adjustable by modifying the gap mentioned.

Identification of the maximum value can be performed by adjusting the metered feed, the overfeed, or both, as well as by adjusting a rotational speed of the development roller.

Since the measurement of developer flow aggregates effects of developer mass density and developer velocity, this measurement is also proportional to the product of independently measured developer mass density, which is also referred to as nap density, and developer velocity, which is also referred to as nap velocity. Flat field uniformity can be improved by maximizing the product of the developer mass density and the developer velocity.

DETAILED DESCRIPTION OF THE INVENTION

Experiments were performed to understand the properties of the developer that influenced the development uniformity of flat fields. Flat field uniformity is a critical part of the quality of the output images of a printer. These experiments first concentrated on developing relationships between certain adjustments made to regulate the flow (grams/inch/second) of developer into the toning zone and the resulting changes in the physical properties of the developer.

Figures 1, 2:
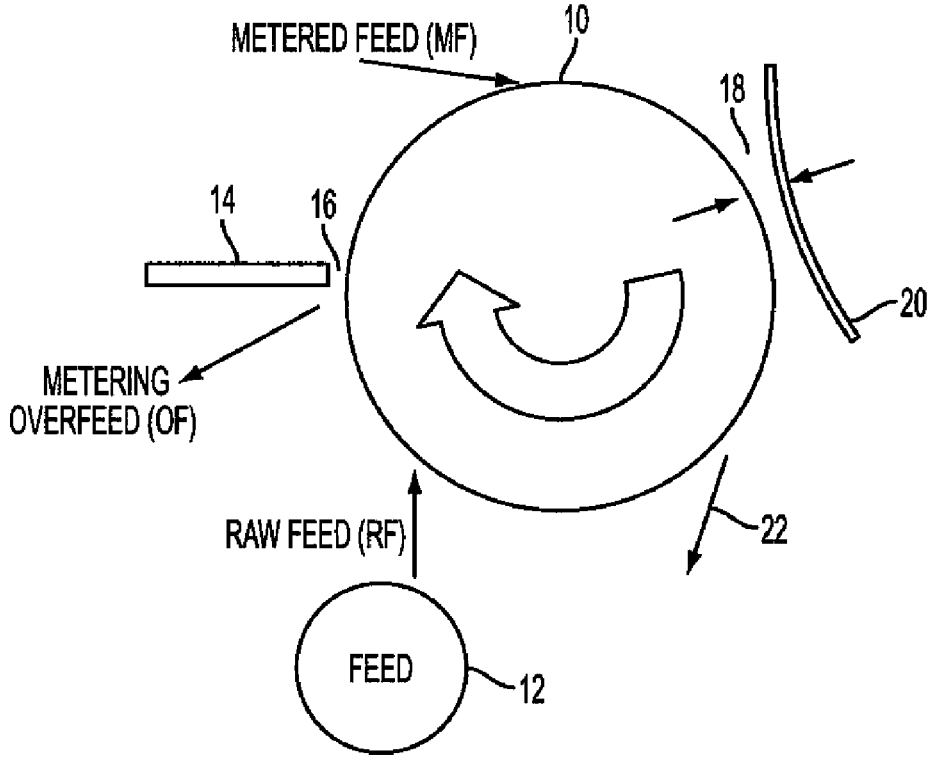
FIG. 1 is a schematic illustration of elements of an image development system used to supply developer to an imaging cylinder and depicts factors of interest in characterizing the effect of developer properties on the development of flat fields.
FIG. 2 is a table summarizing results of an experiment examining the effects of metered developer feed and developer overfeed on resulting flat field image quality.

FIG. 1 schematically illustrates certain elements of an image development system. The arrangement illustrated in FIG. 1 will be used, together with the following description, to facilitate an understanding of factors considered to be of interest in characterizing effects of developer properties on the development of flat fields. In the illustrated arrangement, developer, including toner (for example, dry ink composed of 8 μm particle size polymeric marking powder at 5%-10% by weight) and a carrier (for example, permanently magnetized 30 μm particle size ferrite powder at 90%-95% by weight), is fed from a sump (not shown) to a conventional rotatable development roller 10 by way of a conventional rotatable feed roller 12. The feed roller 12 uses a combination of positive displacement grooves, magnetics, and rotation, in a conventional manner, to deliver developer to the development roller 10. The amount of developer that resides on the development roller 10 before that developer reaches a metering skive or gate 14 is referred to here as raw feed RF.

The metering skive 14 allows only a prescribed amount of developer, referred to here as metered feed MF, to pass through a gap or spacing 16 defined between the metering skive 14 and the development roller 10. The raw feed RF generally exceeds the metered feed MF. Excess developer, resulting from the difference between the raw feed RF and the metered feed MF, is referred to here as overfeed OF. This excess developer is returned back to the sump for future metering.

The metered feed MF passing through the gap 16 is then transported by way of the development roller 10 to another gap or spacing 18 defined between the development roller 10 and an imaging cylinder 20.

The toner is selectively removed from the developer and deposited on charged areas of the imaging cylinder 20 or other appropriate photoreceptive element in conventional fashion to render an electrostatic latent image on that imaging cylinder or other element. The latent image can then be transferred by electric field application to a paper sheet or another desired substrate, again in conventional fashion, and then permanently affixed to the paper or other substrate through application of heat and pressure. The excess or remaining developer is removed from the development roller 10 at a strip area 22, and the removed developer can be replenished with more toner in the sump.

FIG. 2 is a table of data representing a correlation between metered feed MF (grams/inch/second), overfeed OF (grams/inch/second), and the product (ND·NV) of the developer mass density, or nap density, ND (grams/(inches)$^3$) and the developer velocity, or nap velocity, NV (inches/second). The far right column in that table shows the calculated product (ND·NV) values based on models developed from earlier experimentation. The developer mass density is readily ascertainable, for example by weighing a selected volume of developer, and the developer velocity is similarly readily ascertainable, for example from the rotational speed of the development roller 10.

The metric used to evaluate flat field image quality in this experiment is that of "depletion." The dimensionless depletion metric is obtained by way of the following relationship $$DepletionMetric = \sum_{i=0}^{n} (Dr_i - \overline{X})^2,$$

where $Dr_i$ is the reflection density at a particular crosstrack position i; and $\overline{X}$ is the average reflection density of all crosstrack positions. Reflection density thus is utilized to calculate the density differences between a specific area on each sheet and a best fit line for all the sheets. The sum of squares of this area correlates quite well to subjective evaluation of flat field uniformity. For this experiment, a change in uniformity between the first sheet and the twenty-ninth sheet was used as the final metric.

Figure 3:
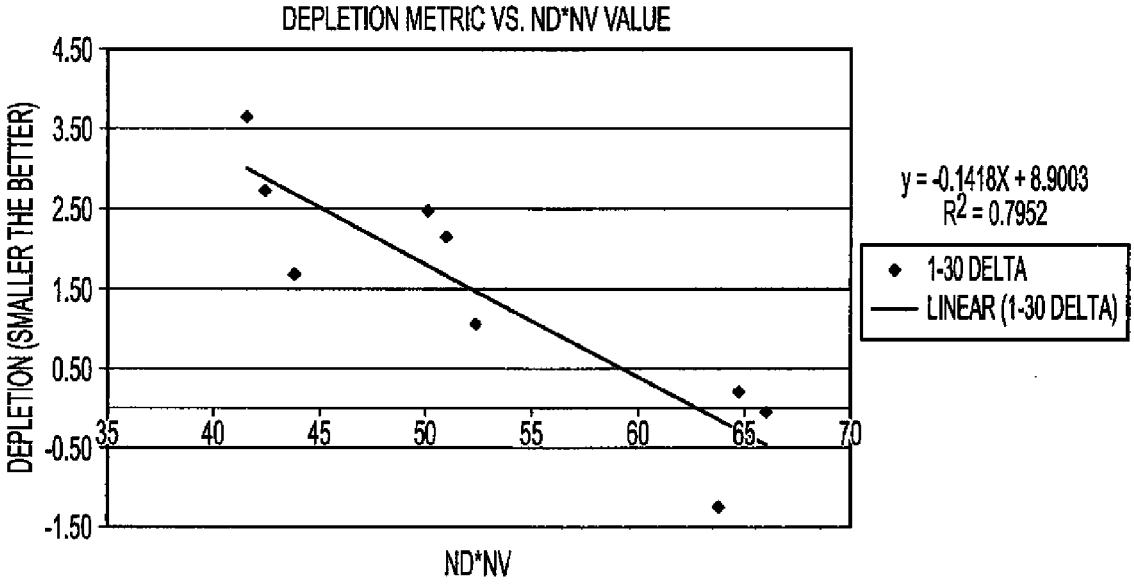
FIG. 3 shows the depletion metric plotted against values of products of developer mass density (nap density) and developer velocity (nap velocity).

FIG. 3 shows the depletion metric plotted against ND·NV product values; in this case, the ND·NV product values are those ND·NV product values set out in FIG. 2. The change in reflection density uniformity, for example between the first sheet and the twenty-ninth sheet, may be ascertained by way of a densitometer, such as that described in prior, commonly assigned U.S. Pat. No. 4,847,659 to Resch, III. The entire disclosure of prior U.S. Pat. No. 4,847,659 to Resch, III is incorporated herein by reference as non-essential subject matter.

Figure 4A:
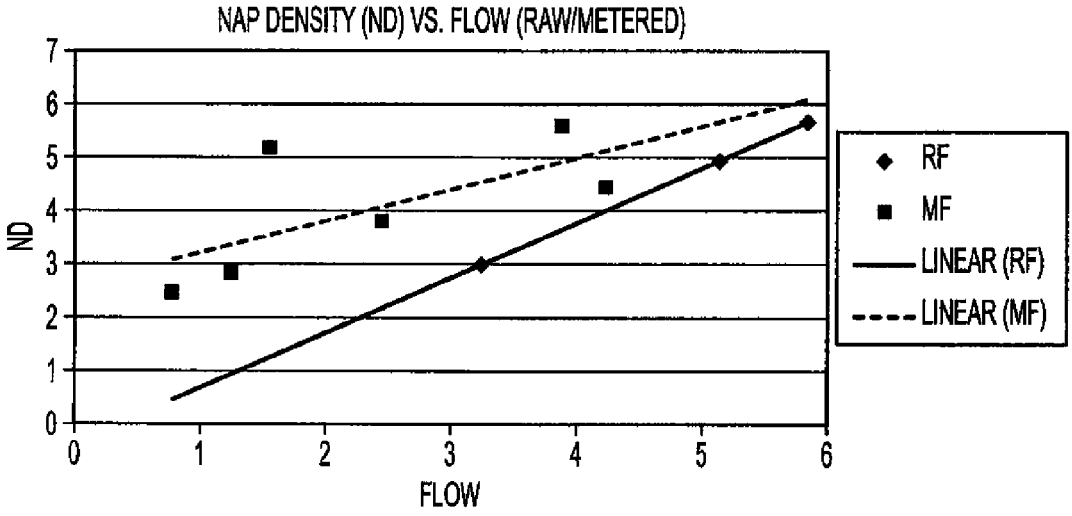
FIG. 4*a* is a plot of developer flow versus nap density.

As is apparent from FIG. 3, flat field uniformity can be improved by maximizing the product (ND·NV) of the developer mass density or nap density ND and the developer velocity or nap velocity NV. The reason for this effect has to do with the mechanics of compressive metering. In general, because of the compressibility of the developer, the metering skive compresses (densifies) the developer and reduces its velocity. Attention is directed to FIG. 4*a*, which illustrates RF and MF data on a graph of developer mass density, or nap density, as a function of developer flow.

Figure 4B:
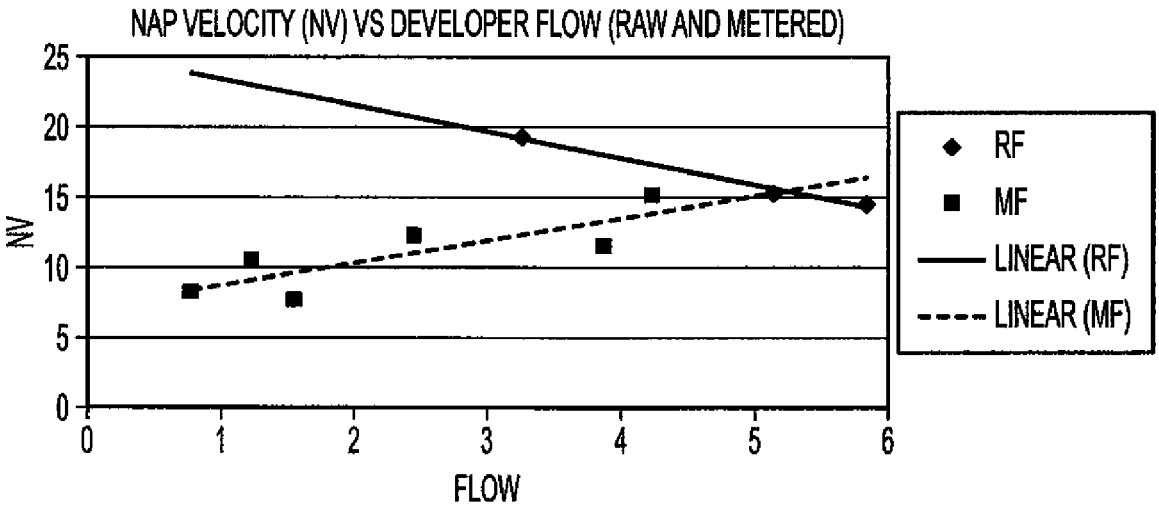
FIG. 4*b* is a plot of developer flow versus nap velocity.

FIG. 4*b* shows RF and MF data on a graph of developer velocity, or nap velocity, as a function of developer flow. This confirms the anecdotal observation that images made without metering (images produced using raw feed only) looked much smoother and had better uniformity. The raw feed can run at higher flow rates before it reaches maximum density, since it does not densify as greatly as the metered feed does.

The data indicate that the measure of ND·NV is superior to the measurement of developer flow in different ways. First, because there is a limit on maximum developer density (over-compression can lead to catastrophic release of the developer from the toning station), measuring ND·NV reveals different aspects of the developer that can be varied (such as velocity) that improve developer ND·NV without the negative side effects of developer over-compression.

Second, the measurement of ND·NV is well suited for real time, non-contact measurements (such as conventional capacitive methods) that can be used for feedback control of feed parameters to optimize image quality.

Figure 5A:
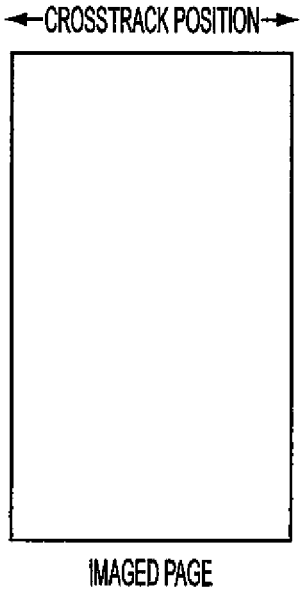
FIGS. 5*a*-5*c* show parameters considered in determining a depletion metric.
Figure 5B:
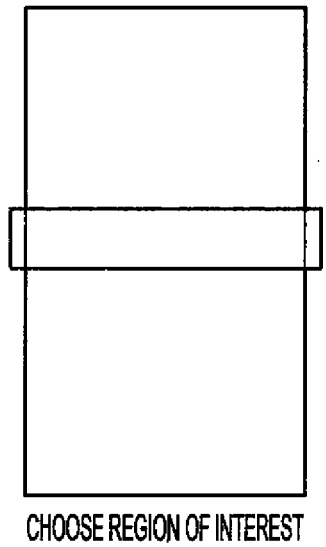
Figure 5C:
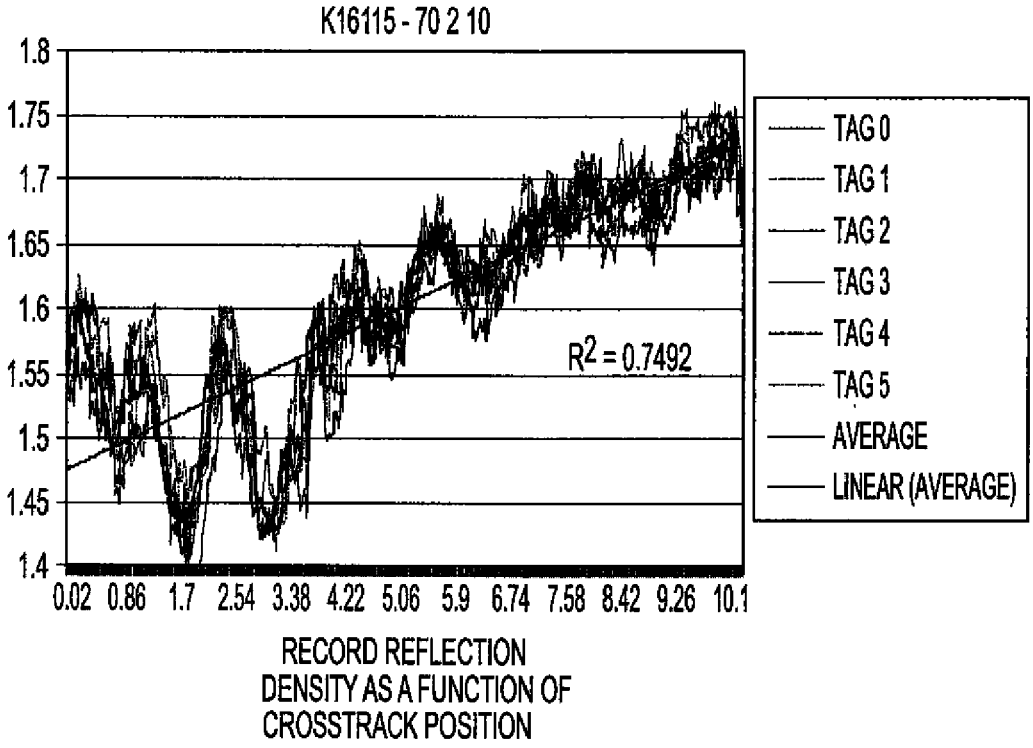

FIG. 5*a* provides a schematic illustration of an imaged page and its associated crosstrack position, FIG. 5*b* provides a schematic illustration of a chosen region of interest on that page, and FIG. 5*c* shows a plot of reflection density recorded as a function of crosstrack position in a process of obtaining the depletion metric noted previously.

The invention has been described in detail with particular reference to certain preferred embodiments thereof, but it will be understood that variations and modifications can be effected within the spirit and scope of the invention.

PARTS LIST

10 . . . development roller
12 . . . feed roller
14 . . . metering skive or gate
16 . . . gap or spacing
18 . . . gap or spacing
20 . . . imaging cylinder
22 . . . strip area

What is claimed is:

1. A process of supplying developer to an imaging element (20) of an image development system having a development roller (10) interposed between a supply of developer and said imaging element (20), comprising:

producing a metered feed (MF) of developer to said development roller (10) and an overfeed (OF) of developer returned to said supply from a raw feed (RF) of developer fed from said supply, determining a plurality of mass densities (ND) of developer used in the system, determining a plurality of developer velocities (NV) through the system, determining respective product values (ND·NV) of said developer mass densities (ND) and said developer velocities (NV), identifying a maximum value of said respective product values (ND·NV), and operating said image development system so that said maximum value is produced.

2. The process according to claim 1, wherein said metered feed is produced by way of a gap between a metering element and said development roller.

3. The process according to claim 2, wherein said metering element is a skive or gate.

4. The process according to claim 2, wherein said metered feed is adjustable by modifying said gap.

5. The process according to claim 1, wherein said maximum value is identified by adjusting at least one of said metered feed and said overfeed.

6. The process according to claim 1, wherein said maximum value is identified by adjusting a rotational speed of said development roller.

7. The process according to claim 2, wherein said maximum value is identified by adjusting at least one of said metered feed and said overfeed.

8. The process according to claim 2, wherein said maximum value is identified by adjusting a rotational speed of said development roller.

9. The process according to claim 3, wherein said metered feed is adjustable by modifying said gap.

10. An image development system for performing the process of claim 1.

11. A process of adjusting flat field uniformity in images produced by an image development system having a development roller (10) interposed between a supply of developer and an imaging element (20), comprising:

supplying a raw feed (RF) of developer from said supply to said development roller (10), producing a metered feed (MF) of developer and an overfeed (OF) of developer that is returned to said supply from said raw feed (RF), determining a plurality of mass densities (ND) of developer used in the system, determining a plurality of developer velocities (NV) through the system, determining respective product values (ND·NV) of said developer mass densities (ND) and said developer velocities (NV), identifying a maximum value of said respective product values (ND·NV), and operating said image development system so that said maximum value is produced.

12. The process according to claim 11, wherein said metered feed is produced by way of a gap between a metering element and said development roller.

13. The process according to claim 12, wherein said metering element is a skive or gate.

14. The process according to claim 12, wherein said metered feed is adjustable by modifying said gap.

15. The process according to claim 11, wherein said maximum value is identified by adjusting at least one of said metered feed and said overfeed.

16. The process according to claim 11, wherein said maximum value is identified by adjusting a rotational speed of said development roller.

17. The process according to claim 12, wherein said maximum value is identified by adjusting at least one of said metered feed and said overfeed.

18. The process according to claim 12, wherein said maximum value is identified by adjusting a rotational speed of said development roller.

19. The process according to claim 13, wherein said metered feed is adjustable by modifying said gap.

20. An image development system for performing the process of claim 11.

* * * * *